United States Patent [19]

Dubois et al.

[11] Patent Number: 4,507,812

[45] Date of Patent: Apr. 2, 1985

[54] DISPENSER FOR A TOILET

[75] Inventors: Jean Dubois, Montmorency; Alain Lacroix, Jouy-en-Josas; Lucienne Forestier, Paris; Jean-Pierre Steiner, Versailles, all of France

[73] Assignee: Lesieur-Cotelle, Boulogne-Billancourt, France

[21] Appl. No.: 510,920

[22] Filed: Jul. 5, 1983

[30] Foreign Application Priority Data

Jul. 5, 1982 [FR] France ..... 82 12037

[51] Int. Cl.[3] ..... E03D 9/02

[52] U.S. Cl. ..... 4/228

[58] Field of Search ..... 4/222–228, 4/231; 222/185, 424.5; 422/263, 264, 266, 277

[56] References Cited

U.S. PATENT DOCUMENTS

| | | | |
|---|---|---|---|
| 4,216,027 | 8/1980 | Wages | 4/228 |
| 4,434,136 | 2/1984 | Wilkinson et al. | 4/228 X |
| 4,450,594 | 5/1984 | Hotchkin | 4/228 |
| 4,451,941 | 6/1984 | Gray | 4/227 X |

*Primary Examiner*—Charles E. Phillips

*Attorney, Agent, or Firm*—Karl F. Ross; Herbert Dubno

[57] ABSTRACT

A dispenser for disinfectant, cleaning agent, coloring agent, deodorant, perfuming agent or the like adapted to be positioned in a toilet tank is formed by thermoforming from synthetic resin foil with a base having cells at least one of which is divided by a partition and has compartments such that the material to be dispensed can be solidified in one of these compartments.

20 Claims, 7 Drawing Figures

DISPENSER FOR A TOILET

FIELD OF THE INVENTION

Our present invention relates to a dispenser for a toilet and, more particularly, to a device for metering a substance into the water adapted to be used in a toilet bowl or WC and, most especially, to a device which can be placed in the tank of a water closet for dispensing a cleaning, deodorizing, disinfecting, perfuming and/or coloring agent therein.

BACKGROUND OF THE INVENTION

A tank-type toilet or WC generally comprises a tank provided with a valve system which, when operated, permits water to flow from the tank into the toilet bowl and discharge the contents thereof prior to establishing a new water level in the bowl. The tank is usually provided with a further valve which controls the filling of the tank to a predetermined level.

It has been proposed heretofore, as a sanitary aid or for esthetic purposes, to provide in the water, a cleaning agent, disinfectant, deodorant or colorant. The cleaning agent can be a detergent.

To reduce manual intervention to the greatest possible extent, it is advantageous to provide a dispenser which is capable of automatically adding such agents to the water.

Efforts at this have included products which are dispensed in a liquid or hard form in the tank and which are more or less rapidly consumed, substances which are suspended in the bowl and likewise rely upon poor solubility for long term effectiveness, and complex metering systems for measuring and delivering precise quantities of the agent to the water.

In this connection, it is known to provide a device which can be positioned, e.g. suspended, within the tank and which uses a siphon action to permit a limited quantity of water to come into contact with the stubstance to be distributed within the device as the tank is filled, and this quantity of water to be discharged from the device when the tank empties into the bowl to carry along the substance which was dispersed in this limited quantity of water.

The siphon action heretofore has required entry and discharge of water through an orifice which tended to become blocked by the substance where the latter was not fully dissolved. Furthermore, earlier devices for this purpose have been relatively complex, of expensive construction and thus not disposable or, if treated as disposable, were of relatively high cost.

Another disadvantage of these earlier devices was the limited versatility in the form in which the substances could be introduced into the device and dispersed in the water.

OBJECTS OF THE INVENTION

It is the principal object of the present invention to provide a device for the purposes described which overcomes the drawbacks of earlier devices as described above and affords an improved dispersal of a cleaning, sterilizing, deodorizing or perfuming and/or coloring agent into the water of a toilet.

Another object of the invention is to provide a dispensing device for a tank of a toilet which is less likely to become blocked by the substances to be dispensed and hence operates more reliably than earlier devices.

Still another object of the invention is to provide a low cost, inexpensively fabricated disposable dispenser for substances to be added to the water of a toilet tank.

SUMMARY OF THE INVENTION

These objects and others which will become apparent hereinafter are attained in accordance with the present invention in a device which comprises a receptacle generally having a parallelepipedal form and adapted to be disposed vertically in a toilet tank with its length extending in the vertical direction and constituted by a base which is hollow or formed with cavities, and a cover which is bonded to this base. The base, according to the invention, comprises at least two cells, one of which extends substantially the full length or height of the receptacle when the latter is in its vertical position and communicates with the exterior by openings at the opposite ends of this long cell, i.e. at the top and bottom thereof. The second cell extends only over part of the length of the receptacle and communicates with the first cell by a pair of apertures spaced one above the other and is divided into two compartments by a partition extending downwardly from an upper side of the second cell to terminate above the lower side thereof, this partition defining passages communicating between the compartments at the upper and lower ends of the partition and preferably reaching to a point just below the lower orifice communicating between the two cells.

The compartment which communicates with the long cell via the two orifices will be referred to as a siphon compartment whereas the other compartment will be referred to as the holding compartment.

According to the invention, the holding compartment is provided with a deeper portion, i.e a portion which is of greater depth than another portion at the bottom of the holding compartment and into which a substance to be dispensed can be cast, i.e. poured in a molten state at a temperature greater than its hardening point with the base in a supine position so that when the receptacle is erected into its vertical orientation, the solidified body of the substance can be liberated from the mold formed by the deeper portion and allowed to contact liquid entering the holding compartment on substantially all of its surfaces. At least the lower part of this body can be guided to fall into the liquid which rises in this holding compartment.

Thus an important aspect of the invention is that the partition not only divides the siphon compartment as mentioned, but also can form a wall of a mold defined by the deeper portion of the holding compartment to permit the substance to be cast in a liquid state in this holding compartment without obstructing any of the orifices, passages or openings communicating between the cells and communicating between the compartments. To this end, the passage at the upper end of the partition may be disposed above the deeper portion even in the supine position of the base while the passage at the lower end of the partition when the receptacle is in its vertical orientation, can lie below the lowest point of the deeper portion.

Furthermore, because the orifices are unobstructed and the body of the substance cast in the deeper portion occupies only part of the volume of the holding compartment, an excellent circulation of water into and out of the device and around the body of the substance in the holding compartment is assured.

The device having a cellular base can readily be formed by conventional thermoforming techniques, e.g.

deep drawn from synthetic resin foil and, because the product to be dispensed can be cast or molded in situ within the base, a large variety of disinfectant, detergents, or deodorants can be used all in liquid or pasty state as long as it can harden in situ.

Preforming of the substances is not necessary and it is not necessary to introduce into the device in a closed state, liquids, pastes, powders or the like.

The cover can be applied after hardening of the active material and can be bonded in place by adhesive bonding or a welding technique, e.g. thermal welding (heat sealing), high frequency bonding, ultrasonic bonding or the like.

Advantageously, the device is suspended in the tank so that during the filling of the latter, water completely fills the long cell, any air within the latter being expelled through the upper opening or openings.

The second cell, however, need not fill completely with water and thus we may prevent complete escape of air from the upper portion of the second cell by providing the uppermost orifice interconnecting the two cells at a location somewhat below the upper ends thereof. Only sufficient water need be admitted to generate the desired concentrated solution of the substance to be dispensed in the second cell.

During discharge of the reservoir, the long cell empties through the lower orifice substantially completely, air returning to the long cell through the upper opening and because air can enter the upper orifice between the two cells, the liquid can be discharged from the second cell through the lower orifice until the liquid level in the second cell falls to the bottom of this lower orifice. The liquid in the second cell rises and falls in contact with the body of the substance so that incoming liquid develops homogeneous distribution of the dissolved substance.

While the position of the receptacle in the tank generally does not matter, as long as the water in the tank drains to a point below the second cell, once the receptacle is in place, its position seldom requires adjustment.

The active mass dissolves only at its portion in contact with the water and, as it dissolves, tends to drop within the second cell. This movement is facilitated by providing downwardly inclined formations to support the body of the active substance, these formations being inclined from the deep portion toward the cover. If the inclined members are spaced apart, they facilitate contact of water with the body while also serving to hold the body above the bottom of the second cell.

For effective operation, we have discovered that there are certain parameters which should be observed. For example, the distance between the bottom of the second cell and the lower orifice connecting the second cell with the first cell should be less than half of the height of this first cell.

The positions and cross sections of the orifice interconnecting the cells should be such that the liquid coming into contact with the substance in the second cell and which is exchanged during each flushing should be between 5 and 40 milliliters.

The difference in height between the lower walls of the two cells should be between 0.2 and 0.8 times the height of the long cell, i.e. the cell which does not contain the active product.

The air cushion forming in the interior of the second cell during filling of the tank and permitting control of the liquid level in the second cell should have a volume between 0.3 and 0.95 times the volume of this second cell.

Finally, the receptacle is dimensioned such that the volume of the first cell is greater than half the difference between the volume of the second cell and the volume of this air cushion when the reservoir or tank is filled with water. In order to achieve the volume ratios described, it is possible to vary the depths of the cells during the thermal drawing of the base.

BRIEF DESCRIPTION OF THE DRAWING

The above and other objects, features and advantages of the present invention will become more readily apparent from the following description, reference being made to the accompanying drawing in which.

SPECIFIC DESCRIPTION

The device according to the invention has been represented generally at 2 and can be considered to comprise a receptacle containing a body 16 of a substance to be dispensed within a toilet tank or reservoir 3 communicating with the toilet bowl 4 in the usual manner. Although not shown, the tank is provided with a valve which permits filling of the tank so that the water can rise therein from the bottom, and another valve permitting flushing of the bowl by draining the tank into the bowl.

The dispenser can be used for delivering a disinfectant, detergent, deodorant and/or colorant to the water at the desired concentration.

Figure 1:
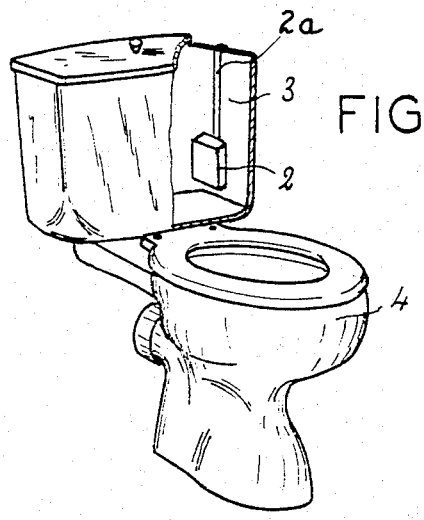
FIG. 1 is a perspective view partly broken away of a toilet provided with a dispenser according to the present invention.
Figure 2:
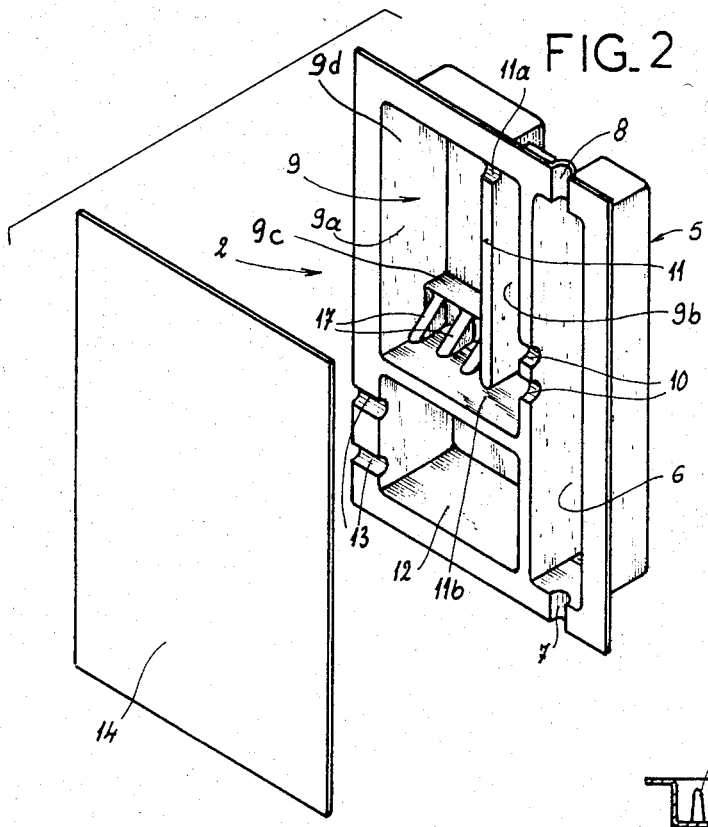
FIG. 2 is an exploded perspective view of the device of the invention from which the cake of the dispensible material has been removed.
Figure 3:
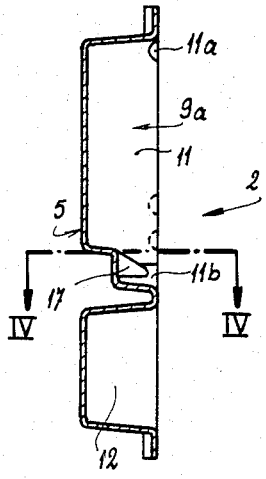
FIG. 3 is a vertical cross section through the base of the receptacle of FIG. 2 taken through the second cell and specifically the holding compartment thereof.

The receptacle 2 is shown in an exploded view in FIG. 2 in which the cover 14 can be seen to be a plastic foil which has not yet been bonded to the bottom or base 5. The base 5 is formed with three cells and the receptacle, when the cover 4 is applied, has a parallelepipedal configuration and is adapted to be sustained, e.g. by wires or strands *2a*, in a vertical orientation in the tank 3. In this vertical orientation, the longitudinal dimension of the receptacle is vertical.

The base 5 comprises a first or long cell 6 open at its upper end by an opening 8 into the tank and its lower end by an opening 7 through which the water enters and emerges. When water rises through opening 7 into the long cell 6, air is displaced out of the opening. Conversely, because air can readily enter the opening 8 when the tank is drained, water drains unimpeded from the long cell 6 back into the tank.

Figure 4:
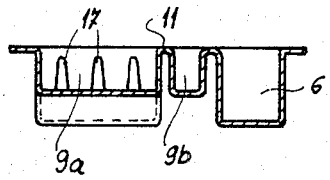
FIG. 4 is a horizontal section through the base along line IV—IV of FIG. 3.

The base 5 is also provided with a second cell 9 extending only over a portion of the height of the receptacle and thus contrasting with the long cell 6 which extends substantially over the full height of the receptacle. The second cell 9 is disposed between the upper wall of the receptacle and one of the lateral walls thereof and is subdivided into two compartments 9a and 9b by a partition 11 which, like all of the other walls and formations of the base are formed unitarily in the foil constituting the latter. The compartment 9b can be comparatively shallow (see FIG. 4) while the compartment 9a has at least a portion of greater depth below a bench 9c and into which the material to be dispensed can be cast or otherwise introduced in a flowable manner so as to harden in situ.

The compartment 9b communicates with the long cell 6 via a pair of vertically spaced orifices 10 and communicates with the compartment 9a via a passage 11a at the upper end of the partition 11 and a passage 11b below the lower end of the partition 11.

The deep portion 9d of the compartment 9a delimited by the bench 9c is located, when the base 5 is in a supine position (FIG. 4), below the passage 11a and is separated by the bench 9c from the passage 11b so that the casting and solidification of the material to be dispensed does not obstruct either of the passages or the orifices 10.

Below the cell 9, we can provide a further cell 11 communicating with the exterior via orifices 13 and adapted to contain another product e.g. preformed block 18 of another material to be dispensed, usually a colorant, deodorizer or disinfectant, whose distortion is controlled only by the rate of dissolution and which it is not necessary to carefully meter into the water. As the water fills cell 12 and exits therefrom, this substance is dispersed without any great precision.

The plug 18, if extrememly soluble, can also be cast in place when the base 5 is disposed horizontally, or molded from a paste since high solubility will preclude long blockage or the orifice 13. After casting or molding of the products to be dispensed within the foil base, the cover 14 can be applied by one of the techniques described above.

The unit of the invention, because it does not require preformation of the body of material to be dispensed, can utilize existing stocks of the substances.

Figure 5:
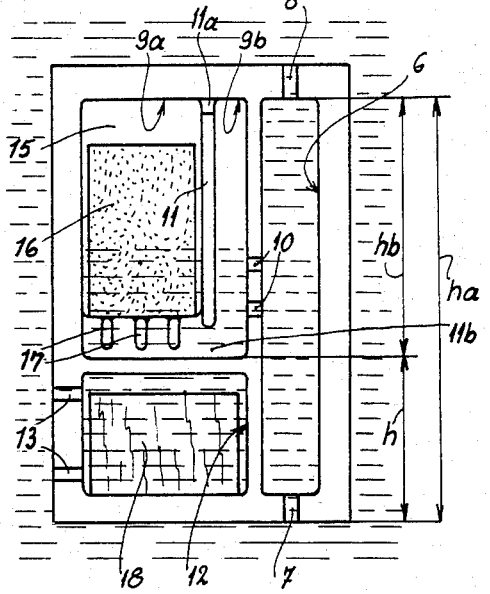
FIGS. 5–7 are diagrams of the receptacle with the cover removed showing the interaction thereof with the water in the tank during different stages of tank filling and emptying.
Figure 6:
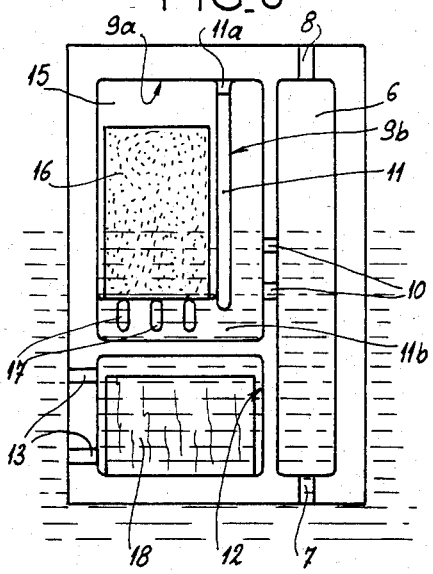
Figure 7:
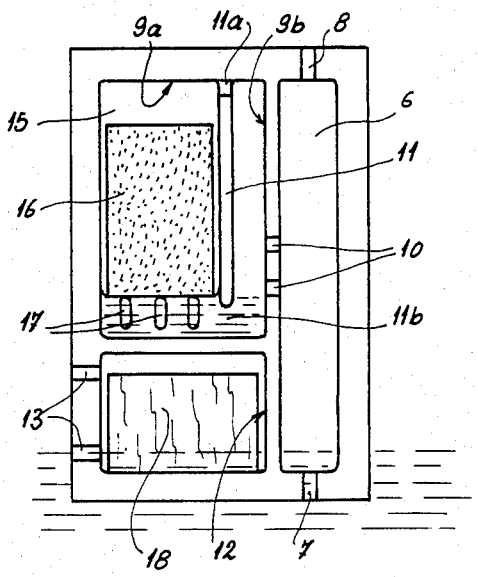

As can be seen from FIGS. 5–7, the height h is equal to the difference between the height ha of the first cell 6 and the height hb of the cell 9 should satisfy the condition $ha/4 \leqq h \leqq 4ha/5$.

As shown in FIG. 5, when the receptacle is in position and the tank is filled, an air cushion 15 is maintained in the upper part of the cell 9 and the volume of this air cushion can be between 0.3 and 0.95 times the volume of cell 9. The volume of cell 6 is greater than half the difference between the volume of the second cell 9 and the air cushion 15.

FIGS. 5–7 also show three phases of operation of the device. After the product 16 has been cast in situ and hardened and the receptacle has been closed, the receptacle is erected into the position shown in FIGS. 5–7, whereupon the body 16 emerges from the deep portion 9d and rides forwardly and downwardly along a plurality of ramps extending from the bench toward the cover 14 and serving to hold the body 16 above the passage 11b. As the body 16 dissolves, it moves downwardly sliding toward the base.

When the tank is filled, water enters the long compartment 6 and passes into lower orifice 10, filling the cell 9 substantially to the level of the upper orifice 10. Air escapes during this process through the opening 8. The air cushion 15 within the cell 9 prevents exposure of the upper part of the body 16 to the water until with repeated use sufficient material is dissolved to cause the upper part to drop into the water.

Upon discharge, water drains from the opening 7 until the upper orifice 10 is unblocked whereupon the water drains from cell 9 and cell 6, the water of the two cells mixing together and then mixing with the water in the tank. The concentrated solution of the active product in cell 9 is thereby diluted first with water from cell 6 and then with the tank water. Further, since much of the tank has already emptied at this point, such dilution is limited to dilution in the water at the lowest portion of the tank.

This stage is represented at FIG. 7 from which it is also apparent that a portion of the liquid in cell 9, forming a concentrated solution of the active product, is retained therein.

The present system greatly improves the dispensing of active materials into the toilet since the fairly concentrated solution can be introduced into the latter stages flushing for maximum cleaning and deodorizing or disinfecting. Waste of the active material is minimized. The receptacle need not be positioned with any accuracy within the tank and the product dispensed is in a dissolved or liquid form immediately. The device has been found to be especially effective even when allowed to stand for long periods for flushes.

The third cell 12 can be eliminated or can be provided with a siphon-type dispenser for another material and to provide the desired relationships of cross sections, the cells can have different depths. When two or more units such as cell 9 are provided, they can have various capacities to liberate various materials to different degrees with each flush.

We claim:

1. A dispenser for discharging a solid substance into a tank of a toilet comprising a receptacle of generally parallelepipedal configuration adapted to be positioned vertically in the tank, said receptacle comprising a base and a cover applied to said base, said base and said cover defining a first relatively long and narrow cell formed with upper and lower openings adapted to communicate with the tank, a second cell provided with a partition subdividing it into a first compartment and a second compartment, said first compartment communicating with said first cell by a pair of orifices spaced vertically along the longitudinal dimension of said cell and with said second compartment by passages at opposite ends of said partition, said second compartment having a deep portion positioned at an elevation lower than one of said passages and higher than the other of said passages; and a body of said substance solidified in situ in said deep portion.

2. The dispenser defined in claim 1 wherein said second cell is provided at its lower end when the receptacle is in a verticle position with ramps for supporting said body.

3. The dispenser defined in claim 2 wherein a cushion of air is trapped in said second cell when the tank is filled with water, said cushion having a volume between 0.3 and 0.95 times the volume of said second cell.

4. The dispenser defined in claim 2 wherein the volume of said first cell is greater than half the difference between the volume of said second cell and the volume of an air cushion formed within said second cell when said tank is filled with water.

5. The dispenser defined in claim 2, further comprising a third cell having orifices communicating with the interior of said tank and adapted to receive another substance to be dispensed into said tank.

6. The dispenser defined in claim 3, further comprising a third cell having orifices communicating with the interior of said tank and adapted to receive another substance to be dispensed into said tank.

7. The dispenser defined in claim 1 wherein the distance between the bottom of said second cell and the lower one of said orifices is less than half the height of said first cell.

8. The dispenser defined in claim 7 wherein said orifices are positioned so that liquid is retained in said second cell to form a concentrated solution of said substances in an amount of 5 to 50 milliliters.

9. The dispenser defined in claim 8 wherein the difference in height between said cells is between 0.2 and 0.8 times the height of said first cell.

10. The dispenser defined in claim 9 wherein a cushion of air is trapped in said second cell when the tank is filled with water, said cushion having a volume between 0.3 and 0.95 times the volume of said second cell.

11. The dispenser defined in claim 10, further comprising a third cell having orifices communicating with the interior of said tank and adapted to receive another substance to be dispensed into said tank.

12. The dispenser defined in claim 9, further comprising a third cell having orifices communicating with the interior of said tank and adapted to receive another substance to be dispensed into said tank.

13. The dispenser defined in claim 9 wherein the volume of said first cell is greater than half the difference between the volume of said second cell and the volume of an air cushion formed within said second cell when said tank is filled with water.

14. The dispenser defined in claim 7, further comprising a third cell having orifices communicating with the interior of said tank and adapted to receive another substance to be dispensed into said tank.

15. The dispenser defined in claim 8, further comprising a third cell having orifices communicating with the interior of said tank and adapted to receive another substance to be dispensed into said tank.

16. The dispenser defined in claim 1 wherein a cushion of air is trapped in said second cell when the tank is filled with water, said cushion having a volume between 0.3 and 0.95 times the volume of said second cell.

17. The dispenser defined in claim 16, further comprising a third cell having orifices communicating with the interior of said tank and adapted to receive another substance to be dispensed into said tank.

18. The dispenser defined in claim 1 wherein the volume of said first cell is greater than half the difference between the volume of said second cell and the volume of an air cushion formed within said second cell when said tank is filled with water.

19. The dispenser defined in claim 1, further comprising a third cell having orifices communicating with the interior of said tank and adapted to receive another substance to be dispensed into said tank.

20. The dispenser defined in claim 1 wherein said receptacle is provided with a plurality of cells for disbursing respective substances into said tank at the terminal part of the discharge of water therefrom.

* * * * *